United States Patent [19]

Zodrow

[11] Patent Number: 4,467,847

[45] Date of Patent: Aug. 28, 1984

[54] MACHINE FOR LABELING AND/OR FILLING BOTTLES ALONG TWO PATHS

[75] Inventor: Rudolf Zodrow, Düsseldorf, Fed. Rep. of Germany

[73] Assignee: Jagenberg AG, Dusseldorf, Fed. Rep. of Germany

[21] Appl. No.: 386,161

[22] Filed: Jun. 7, 1982

[30] Foreign Application Priority Data

Jun. 19, 1981 [DE] Fed. Rep. of Germany ..... 3124032

[51] Int. Cl.[3] ..... B65B 3/04

[52] U.S. Cl. ..... 141/98; 141/99; 141/169; 53/202; 198/339

[58] Field of Search ..... 141/98, 99, 129-191; 53/202; 198/339, 570, 344, 345

[56] References Cited

U.S. PATENT DOCUMENTS

| | | | |
|---|---|---|---|
| 1,822,111 | 9/1931 | Richardson et al. | 198/339 |
| 2,775,269 | 12/1956 | Breeback | 141/99 |
| 3,047,032 | 7/1962 | Carter | 141/99 |
| 3,238,979 | 3/1966 | Richter et al. | 141/169 |
| 3,538,678 | 11/1970 | Lefort | 53/202 |
| 3,765,460 | 11/1973 | Bedin | 141/98 |

*Primary Examiner*—Houston S. Bell, Jr.
*Attorney, Agent, or Firm*—Sprung, Horn, Kramer & Woods

[57] ABSTRACT

In a processing machine for objects, such as a labeling or filling machine for bottles, comprising a turntable having at least two arcuate transport path sections each for one string of objects and stationary or co-moving processing structure, such as labeling stations or filler spouts, associated with these transport path sections, transfer structure disposed at the points of entrance and exit of the transport path sections, and infeed and outfeed conveyors, the improvement which comprises disposing the infeed conveyor (12) leading to the transfer structure (23, 24) of one transport path section and the outfeed conveyor (20) adjoining the transfer structure (19, 18) of the other transport path section alongside one another and approximately over the center of the turntable (1). The machine can be adapted to perform multiple operations on each path section, such as filling and labeling, and the operations can be different on the two sections. The machine is simpler, less expensive and takes less room than two separate machines, and both sections can readily be monitored by a single machine operator.

10 Claims, 10 Drawing Figures

MACHINE FOR LABELING AND/OR FILLING BOTTLES ALONG TWO PATHS

BACKGROUND

Figure 1:
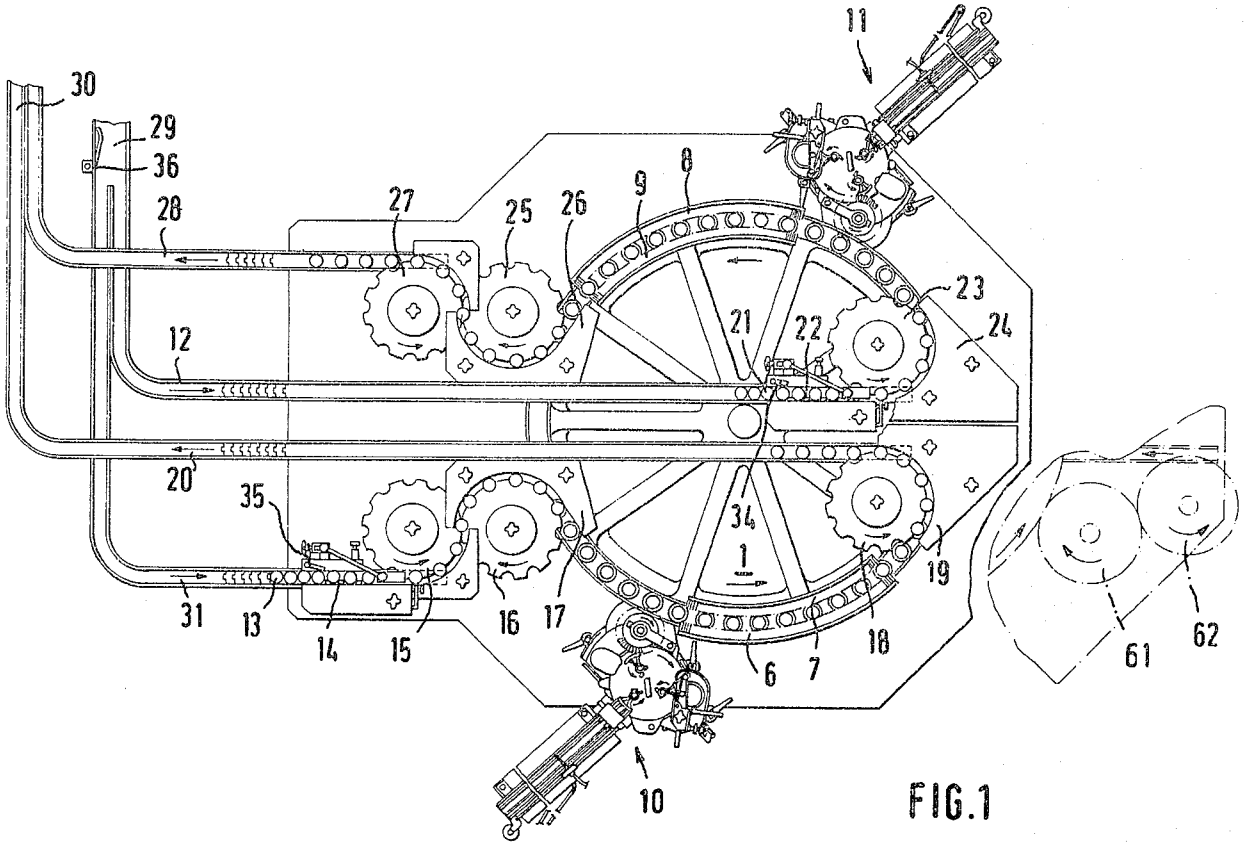

The invention relates to a machine for processing objects, especially a labeling machine or filler for containers such as bottles, consisting of a plurality of work stations disposed in a peripheral area about a turntable which has at least two arcuate transport path sections, one for each string of the objects, and stationary or synchronously moving processing means, such as labeling stations or filler spouts associated with these transport path sections, as well as transfer devices, especially in the form of entrance and exit star wheels, which adjoin infeed and outfeed conveyors, especially belt conveyors.

In the processing of containers, such as bottles, one factor determining the maximum output is the maximum possible speed at which the containers can be transported. Another factor is the maximum allowable noise level. To respect these limitations on the output of the processing machine, it has been common, when a high output is desired, to install two complete processing machines side by side. According to a more recent, as yet unpracticed, proposal, a greater output can also be achieved without exceeding the maximum possible transport speed by dividing a turntable which carries the objects in a single dense path past processing stations into two arcuate transport path sections, one for each string of containers. In this case an entrance for the one string of containers is directly adjacent the other string of containers. The transfer means at the entrances and exits are in the form of entrance and exit star wheels situated outside of the turntable. The infeed and outfeed conveyors of the two strings of objects are situated on opposite sides of the center line of separation between the two arcuate transport path sections. Thus the amount of space required is slightly smaller than that required by two complete processing machines, and the cost of the machinery involved is reduced. Furthermore, the transport path sections situated between the entrance and exit star wheel of each string of objects are accessible to the operator only by crossing over the infeed and outfeed conveyors.

THE INVENTION

The invention is addressed to the problem of creating a machine for treating objects, by which the same output can be achieved as with two complete machines, but which does not require such a great expenditure on machinery, which does not have such a great need for space, and in which the transport path sections are easily accessible to service personnel.

This problem is solved in a machine of the kind described above in that the infeed conveyor leading to the transfer means of the one transport path section and the outfeed conveyor adjoining the transfer means of the other transport path section run side by side and substantially parallel to one another and cross approximately over the center of the turntable inside the peripheral work area of the work stations.

In the processing machine of the invention, the space between the two transport path sections in the middle of the turntable is utilized for the infeeding or outfeeding of the processed or not yet processed bottles. This not only saves space for the installation of the processing machine, but also the arcuate transport path sections where the bottles are treated remain freely accessible to the personnel. The processing machine can be used to perform a variety of tasks in labeling and filling. Thus it is possible to deliver the objects, such as bottles, from a common storage through the infeeder into both of the transport path sections and there provide them with a variety of labels and to return them separately so that the bottles can be sorted according to the different labels and packed in cases. Such labeling tasks are involved when bottles filled with the same contents are to be provided with different labels for domestic use and foreign use. If the feeds are separate, it is furthermore possible to provide bottles of different contents with labels corresponding to their contents on the same labeling machine, and to feed them out of the processing machine separately according to their contents and labeling. It is also possible to process containers of different heights. To set up the machine for this work, only the cam controlling the members by which the containers are held at top and bottom on the one transport path section need be changed. Lastly, it is also possible to operate the two transport path sections independently of one another, for example to let one transport path section run idle. This kind of operation is desirable when repair work has to be performed on the stations associated with the idle transport path section. Processing on the other transport path section can then continue undisturbed. The idling of the transport path section can be produced by operating a means for blocking the movement of the bottles.

According to one development of the invention, the blocking and releasing of one or both transport path sections can be utilized for controlling the output of the processing machine. In this case the amount of bottles or other objects in a conveyor preceding the infeed conveyors or in the infeed conveyors themselves can be controlled by a detector which blocks or releases the feeding of the objects at least to one of the transport path sections depending on the available quantity of the objects. If the processing machine is constructed as a filler, the number of objects filled can be adjusted between 100% and 50% without affecting the filler (filling time remains constant). In this type of output control, the optimum fill time for the filling of the individual objects remains unchanged.

Arranging the infeed and outfeed conveyor over the center of the turntable makes possible an additional space-saving and easy-to-operate embodiment of the invention, in which all of the infeed and outfeed conveyors are disposed on the same side of the turntable and especially run along-side one another. Such a processing machine is freely accessible to operating personnel over virtually its entire periphery. Since all of the transfer means are arranged on a single, limited part of the periphery, the operator can easily inspect the infeed and outfeed. Since the objects are to be fed in and fed out of both of the transport path sections through common adjoining conveyors, but the infeed and outfeed conveyors for both of the sections are contained one inside the other, in order to bring the processed and unprocessed bottles together without intersection, the infeed conveyors are disposed outside of the turntable at a higher or lower plane than the outfeed conveyors and are carried one above the other each to one adjoining conveyor without intersection.

A particularly compact construction of the processing machine is achieved if one or preferably both of the transfer means to which the infeed conveyor leads or to which the outfeed conveyor is connected are disposed in the area within the turntable.

Different processing machines can be arranged in series. In such a case one or more of the other processing machines are disposed between the infeed and/or the outfeed conveyor and the transport path section of the turntable following or preceding. For example, if the first processing machine in the direction of transport is a filler, the next processing machine can be a capper and the third processing machine a labeling machine. The principle of the invention can be followed in these additional processing machines also.

According to another proposal, a bottle processing machine in the form of a labeling machine having two transfer means located especially within the turntable and disposed between the transport path sections and the infeed and outfeed conveyors running over the center of the transport table can be converted to a double labeling (back label and body label) system by disassembling the two transfer means together with their drive and their guiding switches and replacing the means controlling the holding of the containers by the top and bottom during transport and their release in the area of the transfer means, with a different control which causes the containers to continue to be held in the area of the transfer means, and replacing the control in the area of the second labeling station which turns the containers to certain rotational positions during transport with a different rotator control turning the containers to a rotational position appropriate for the second labeling. In the use of a labeling machine converted in this manner, the infeed conveyor and outfeed conveyors which extend over the turntable center and remain unused do not interfere, since they are situated in an area between the operating infeed and outfeed star wheels that is not used for the processing of the bottles.

Figure 2:
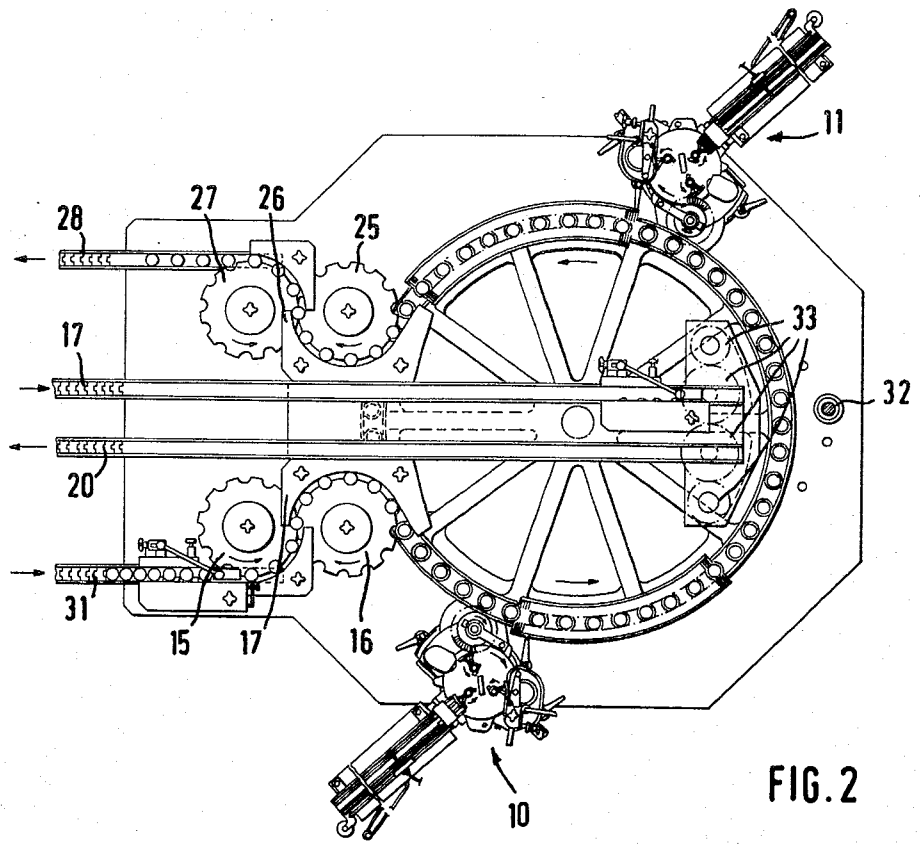
Figure 3:
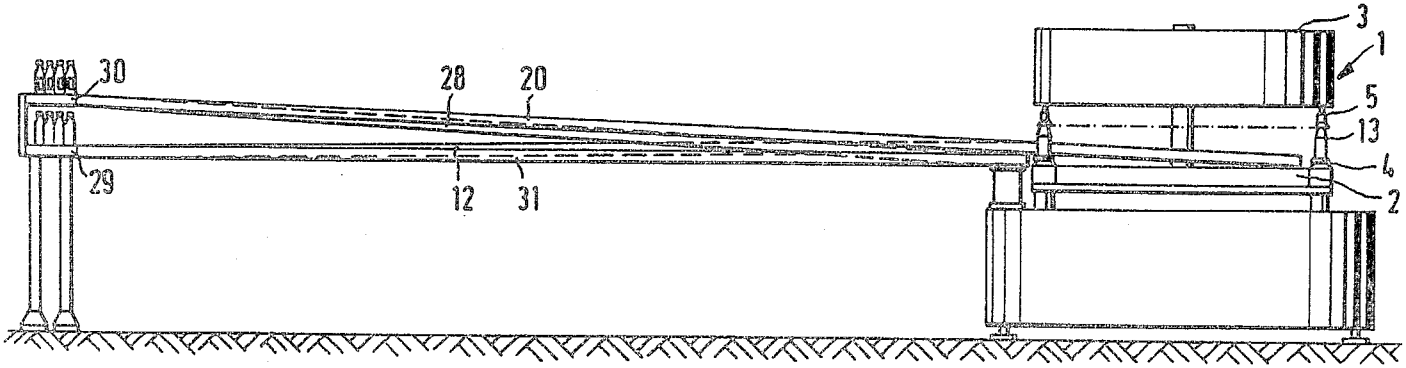
Figure 4:
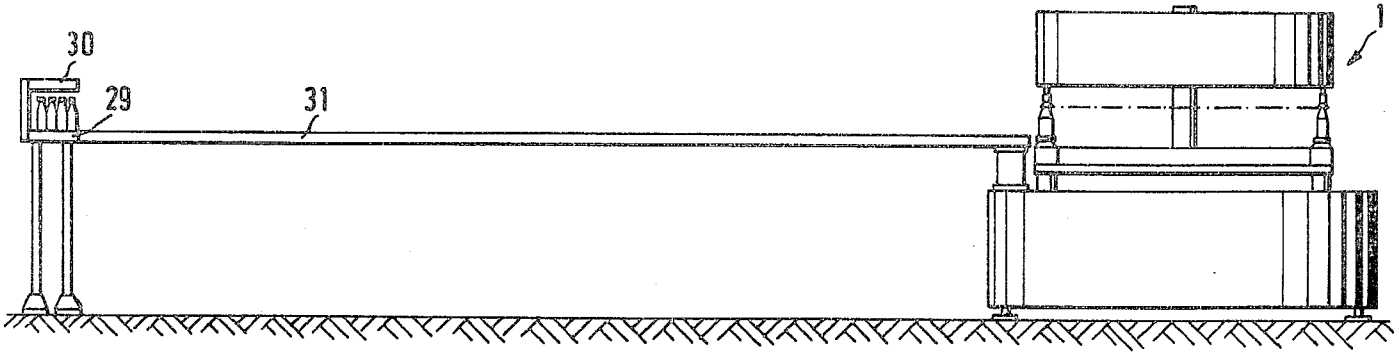
Figure 5:
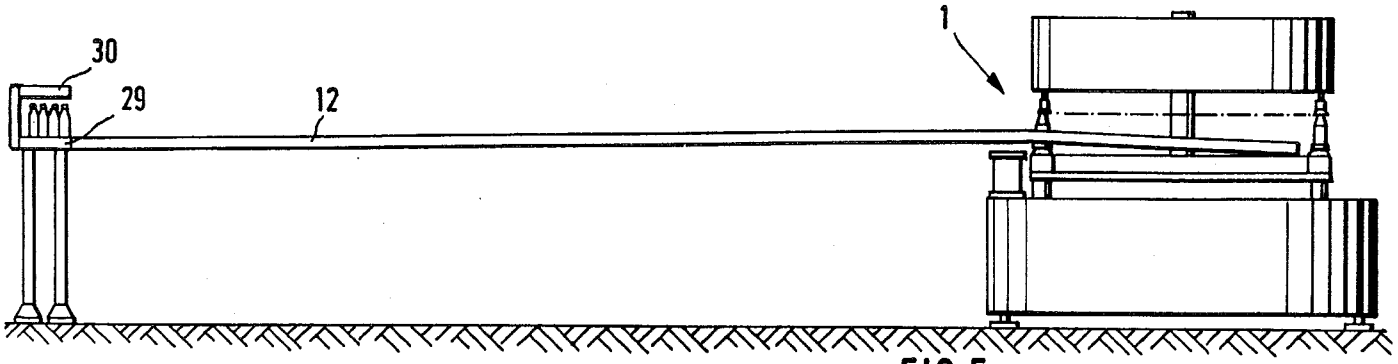
Figure 6:
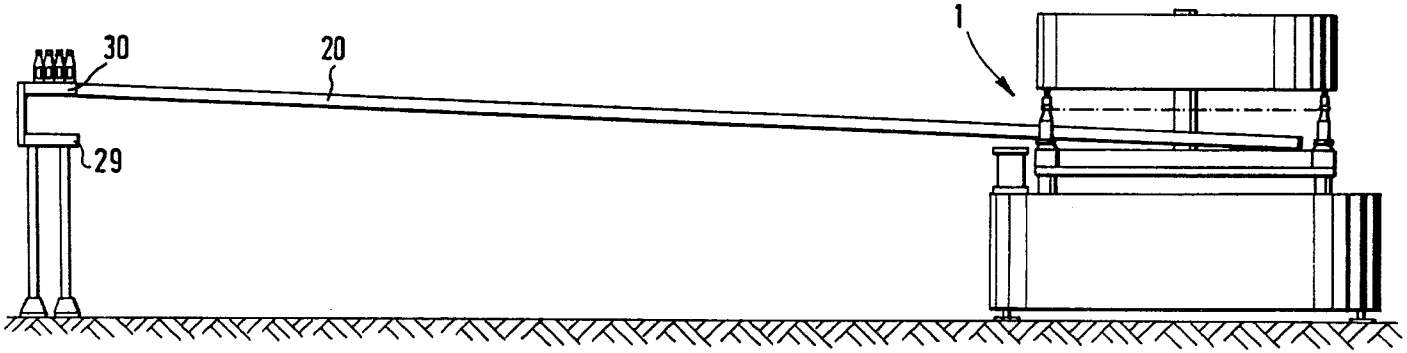
Figure 7:
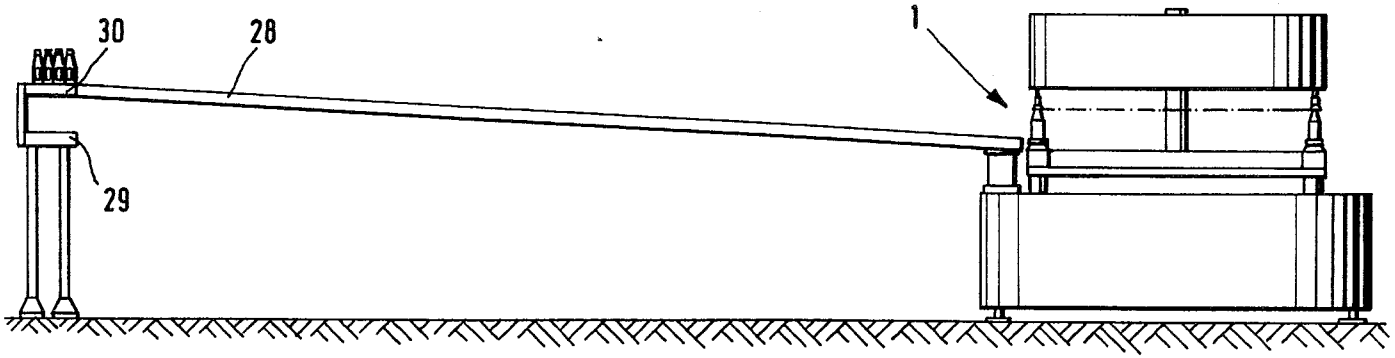
Figure 8:
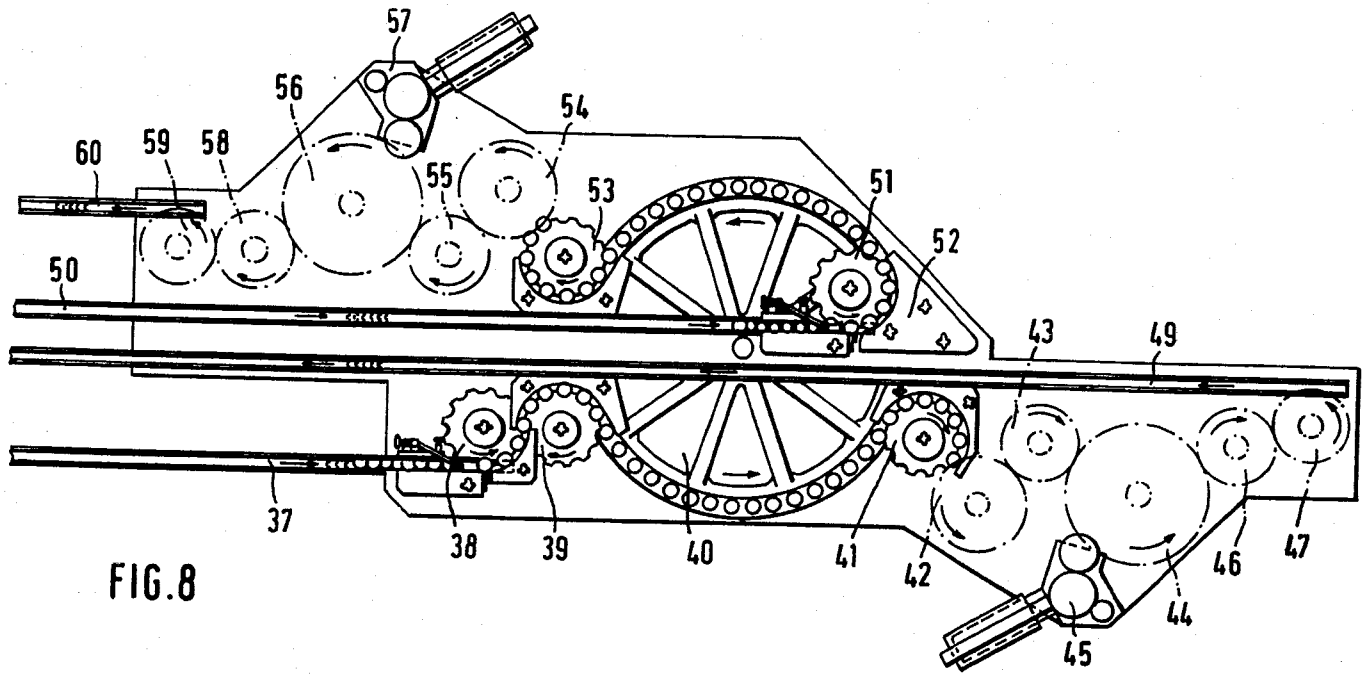
Figures 9, 10:
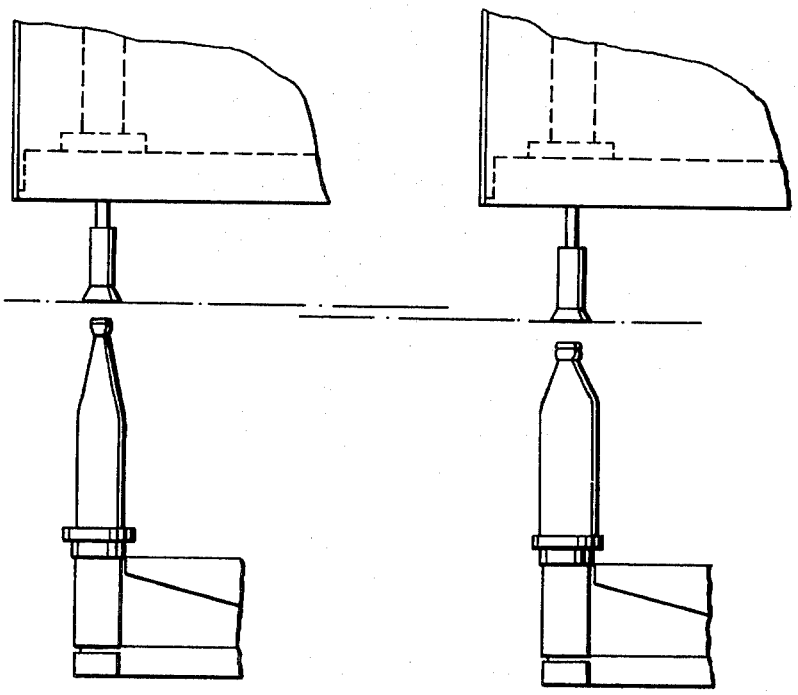

The invention will be further described with reference to the accompanying drawings, wherein:

FIG. 1 is a diagrammatic top view of a bottle processing machine in the form of a labeling machine, FIG. 2 is a diagrammatic top view of the bottle processing machine of FIG. 1 after conversion, FIG. 3 is a side elevational view of the processing machine of FIG. 1 with infeed and outfeed conveyors, FIG. 4 is a side elevational view of the processing machine of FIG. 1 with infeed conveyor for the one arcuate transport path section, FIG. 5 is a side elevation of the processing machine of FIG. 1 with the infeed conveyor for the other transport path section, FIG. 6 is a side elevational view of the processing machine of FIG. 1 with an outfeed conveyor for the one transport path section, FIG. 7 is a side elevation of the processing machine of FIG. 1 with an outfeed conveyor for the other transport path section, FIG. 8 is a top diagrammatic view of a processing machine in the form of a filler, in combination with cappers and labeling machine, and FIGS. 9 and 10 illustrate different bottles in the bottle holders on two different transport path sections.

The bottle processing machine set up as a labeling machine, which is represented in the drawing, has a turntable 1 rotating in the direction of the arrows and consisting of a bottom part 2 and a top part 3. The bottom part 2 bears at the outer margin a series of bottle rotators 4. The top part 3 bears bottle top holders 5 associated with the bottle rotators, which can be raised and lowered against the turntable, so that bottles can be held against rotation between the rotators 4 and the bottle top holders 5. The rotation of the bottle rotators 4 is controlled by means not represented, so that the bottles are rotatable to specific rotatory positions as they are transported. Along the transport path there are disposed on both sides the brushes 6, 7, 8 and 9 as well as a labeling station 10, 11, ahead of each of the brushes 6 to 9 in the transport direction. The transport path of the turntable 1 determined by the bottle rotators 4 and the bottle top holders 5, which constitute means for gripping the bottles, is divided into two approximately semicircular transport path sections. The bottles 13 which are to be labeled are fed to the transport path section represented in the lower part of FIG. 1 by an infeed conveyor 31. The bottles pass through a spacing screw 14 and a transport star wheel 15 to a transfer device in the form of an infeed star wheel 16 which, in conjunction with the guide 17, transfers the bottles 13 with the proper spacing to the turntable 1, which grips the bottles 13 at top and bottom between bottle rotator 4 and the bottle top holder 5. When the bottles pass the first labeling station 10, a label is transferred to the bottles 13, and as transport continues between the brushes 6 and 7 it is completely laid against the bottle. At the same time the bottle is rotated on its own axis by its rotator. The bottles labeled in this manner then enter into a transfer means in the form of an outfeed star wheel 18 and guide 19. In order for the bottles to be able to be transferred here, it is necessary that the bottle holding means 4 and 5 be released. The transfer means 18, 19, transfers the bottles 13 to an outfeed conveyor 20 disposed between the bottom part 2 and the top part 3 of the turntable 1, approximately over the turntable center.

To the other transport path section represented in the upper part of FIG. 1 the bottles 21 are fed by an infeed conveyor 12 which, like the outfeed conveyor 20, is carried between the bottom part 2 and the top part 3 of the turntable 1 and approximately over its center. From the infeed conveyor 12 the bottles 21 pass over a spacing screw 22 disposed between the upper part 2 and lower part 3 and a transfer means consisting of the infeed star wheel 23 and the guide 24 into the transport path section where they are gripped between the bottle rotator 4 and the bottle top holder 5. In this gripped position they are moved past the labeling station 11, and brought into the reach of the brushes 8 and 9 where the label is flattened down under the bottle's own rotation. From this transport path the bottles 21 pass through an additional transfer means consisting of an outfeed star wheel 25 and a guide 26, and an additional star wheel 27, to the outfeed conveyor 28.

The labeling machine represented in FIG. 1 can also be used for the foil wrapping of the bottle neck and top. In this case, however, the outfeed star wheel 18 is replaced by another outfeed star wheel 61 and transfer star wheel 62 represented in broken lines on the right side of FIG. 1. The wiping and smoothing elements not represented in the drawing are then disposed in the area of the outfeed star wheels 25 and 61 and/or the transfer star wheels 27 and 61.

In the processing machine of FIG. 1, the outfeed conveyors 20 and 28 can also be of a double row configuration, in which case a sorting system is provided at the entry of the outfeed conveyors and is actuated by a control system which inspects the containers for proper labeling and/or fill.

The configuration of the infeed conveyors 31 and 12 and of the outfeed conveyors 20 and 28 can be seen in FIGS. 3 to 7. The infeed conveyors 31 and 12 and outfeed conveyors 20 and 28 run to or from common connecting conveyors 29 and 30. On account of the different levels at which the parallel infeed and outfeed conveyors 31, 12, 20 and 28 are disposed, the bottles are transferred to and from the common connecting conveyors without crossing.

If the outfeed star wheel 18 and the infeed star wheel 23 are disposed between the bottom part 2 and the top part 3 of the turntable 1, they are driven by a horizontal shaft carried between the lower part 2 and the upper part 3 and indicated only by the broken lines, the shaft being driven by a shaft 32 (FIG. 2) situated outside of the turntable 1 and connected to the machine drive, and being connected to the gears 33 which are in engagement with one another. If the processing machine is to be operated with only one string of containers, that is, if the transfer systems 18, 19, 23 and 24 are to be removed, it is necessary to remove this horizontal drive shaft, too, so that the bottles will be able to pass without interference through the area of the transfer means 18, 19, 23 and 24.

To be able to use the labeling machine of FIG. 1 for double labeling, involving for example the application of a body label and back label, the transfer means 18, 19, 23 and 24 disposed between the top part 3 and the bottom part 2 of the turntable 1 are taken apart, and the controls of the bottle gripping means 4 and 5 in the area of the transfer means and the rotary control in the area of the second labeling station 11 are modified. Usually the modification consist in replacing the corresponding cam sections so that the bottle will remain gripped in the area of the removed transfer means 18, 19, 23 and 24, and, in the area of the second labeling station, the still-unlabeled side of the bottle will face the labeling station 11.

The infeed conveyor 12 and the outfeed conveyor 20 in the central part of the turntable 1 do not have to be removed because they are out of the way of the bottles and therefore they do not interfere with the process (labeling). It is necessary only to make provision, by means of a lock 34, 35, or by shutting off the infeed conveyor 12, so that no bottles can pass over it into the reach of the turntable 1.

The locks 34, 35, which interrupt the transport of the bottles, can serve also to provide an automatic control of the output of the machine in conjunction with a detector 36 which is provided as a bottle supply detector on the common conveyor 29 for both of the infeed conveyors 12 and 31. If the detector 36 detects an insufficient number of bottles for supplying both of the infeed conveyors 12 and 31, one of the locks 34 and 35 is activated. The rotatory speed of the turntable 1 and the other parts of the processing machine which operate in synchronism therewith do not have to be slowed down. In this case the activation of either of the locks 34 and 35 reduces the output of the entire processing machine by 50%. Such a control of output is advantageous mainly in the case of container fillers which are to be operated at a very constant rotatory speed. This is because only at constant rotatory speed is it possible to be sure that the optimum timing of the bottle filling operation will be preserved.

In the embodiment represented in FIG. 8, a bottle processing machine in the form of a filler is shown, with other processing machines connected in series. From a first infeed conveyor 37 the bottles pass over entry star wheels 38 and 39 into one transport path section of the turntable 40 of the filler. Through an exit star wheel 41 disposed outside of the turntable, the filled bottles come to a capper 42 which transfers the bottles through an intermediate star wheel 43 to a turntable 44 of a labeling machine which carries the bottles past a labeling station 45 for the application of the label. Through an outfeed star wheel 46 and a return star wheel 47 the bottles arrive at an outfeed conveyor 49 running approximately centrally between the upper and lower parts of the turntable of the filler.

From a second infeed conveyor 50 the bottles pass over a transfer means consisting of an entrance star wheel 51 and a guide 52 and disposed between the upper part and lower part of the turntable 44, into the second transport path section of the turntable 44 of the filler. The filled bottles are transferred by means of an outfeed star wheel 53 to a capper 54 from which the bottles pass through an intermediate star wheel 55 onto the turntable 56 of a labeling machine. The turntable 56 transports the bottles past a labeling station 57 which transfers the labels to the bottles. From the turntable 56 the bottles pass through an outfeed star wheel 57 and another star wheel 59 onto an outfeed conveyor 60.

If containers of different height are to be processed, a cam is provided for the gripping means in the area of one or the other transport path section, and its level is such that the bottle top holder is held at a level from which its stroke is equal to the stroke performed in the area of the other transport path section. In FIGS. 9 and 10 this difference between the two transport path sections is represented diagrammatically.

It will be appreciated that the instant specification is set forth by way of illustration and not of limitation, and that various modifications and changes may be made without departing from the spirit and scope of the present invention.

I claim:

1. In a processing machine comprising a plurality of work stations disposed in a peripheral work area about a turntable, said turntable having at least two arcuate transport path sections wherein said transport path sections have transfer means disposed at points of entrance and exit of the transport path sections, and infeed and outfeed conveyors leading to said transfer means, the improvement comprising disposing the infeed conveyor associated with a first of said arcuate transport path sections and the outfeed conveyor associated with a second of said arcuate transport sections substantially parallel to one another and crossing over the center of said turntable inside the peripheral work area of said work stations.

2. A processing machine according to claim 1, wherein all of the infeed and outfeed conveyors are disposed on the same side of the turntable and run side by side.

3. A processing machine according to claim 2, wherein the infeed conveyors are disposed outside of the turntable at higher or lower levels than the outfeed conveyors and are carried one over the other without intersection to a connecting conveyor.

4. A processing machine according to claim 1, wherein at least one of the transfer means to which the infeed conveyor leads or to which the outfeed conveyor is connected is disposed in the area within the turntable.

5. A processing machine according to claim 1, wherein at least one additional processing machine is disposed in series between the infeed and/or outfeed conveyor and the preceding or following transport path section of the turntable.

6. A processing machine according to claim 1, wherein the infeed conveyors are connected to a common conveyor, the machine including detecting means for controlling the quantity of objects on the conveyor and/or on the infeed conveyors by blocking or releasing the transport of the objects at least to one of the transport path sections depending on the amount of objects.

7. A processing machine according to claim 1, wherein each transport path has an infeed and outfeed conveyor, the machine including means for by-passing the exit of one of the paths and the entrance of the other path, and means for directing a bottle after being worked upon in first path to the second path to be further worked upon there, whereby when the by-pass means is operative each bottle will enter the machine and traverse both paths before exit.

8. A processing machine according to claim 1, wherein the machine is a labeling machine, separate outfeed conveyors being provided for the two transport sections, whereby different labels can be applied in each section.

9. A processing machine according to claim 1, wherein the infeed and outfeed conveyors for each section are separate from one another whereby different labeling or degrees of filling can be effected at each section.

10. A processing machine according to claim 9, including means for sensing the container height whereby upon simultaneously supplying containers of different heights the sensing means supplies each to a respective path section in dependence upon its height.

* * * * *